US008549772B2

(12) United States Patent
Crain

(10) Patent No.: US 8,549,772 B2
(45) Date of Patent: Oct. 8, 2013

(54) FOOTWEAR CONSTRUCTION ELIMINATING THE USE OF A FOXING OR A FOXING-LIKE BAND

(76) Inventor: Roger John Crain, Potomac, MD (US)

( * ) Notice: Subject to any disclaimer, the term of this patent is extended or adjusted under 35 U.S.C. 154(b) by 594 days.

(21) Appl. No.: 12/702,581

(22) Filed: Feb. 9, 2010

(65) Prior Publication Data

US 2011/0192060 A1 Aug. 11, 2011

(51) Int. Cl.
*A43B 13/28* (2006.01)

(52) U.S. Cl.
USPC ..... 36/12; 36/23

(58) Field of Classification Search
USPC ..... 36/12, 11, 14, 19.5, 21, 22 R, 23, 4
See application file for complete search history.

(56) References Cited

U.S. PATENT DOCUMENTS

| | | | | | |
|---|---|---|---|---|---|
| 2,063,227 | A * | 12/1936 | Calvin | ..... | 36/12 |
| 2,364,816 | A * | 12/1944 | Quinn | ..... | 36/12 |
| 2,918,735 | A * | 12/1959 | Johnston | ..... | 36/14 |
| 2,958,965 | A * | 11/1960 | Scala | ..... | 36/16 |
| 7,159,335 | B2 * | 1/2007 | Chen | ..... | 36/4 |
| 2002/0040537 | A1 * | 4/2002 | Polegato Moretti | ..... | 36/14 |

* cited by examiner

*Primary Examiner* — Ted Kavanaugh
(74) *Attorney, Agent, or Firm* — Kenyon & Kenyon LLP

(57) ABSTRACT

Embodiments of the present invention provide a footwear construction and method of constructing footwear that may include an outsole having a sidewall that defines a perimeter of the outsole. The footwear construction may also include an upper coupled to the sidewall around the perimeter of the outsole, wherein the sidewall overlaps the upper by less than the critical distance for at least 60% of the perimeter of the outsole.

3 Claims, 8 Drawing Sheets

-- PRIOR ART --
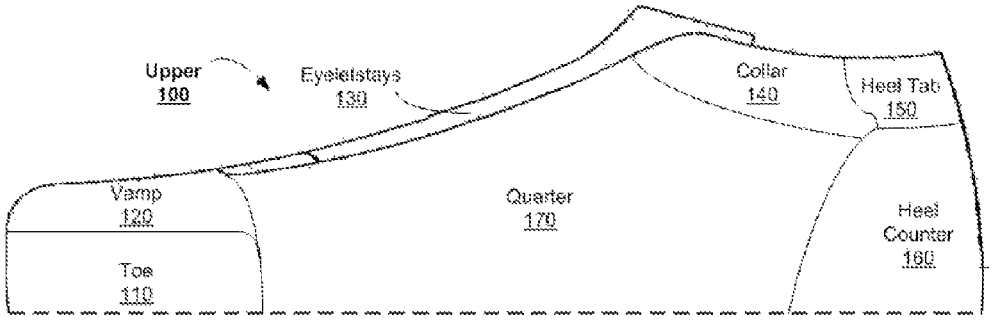
FIG. 1
-- PRIOR ART --
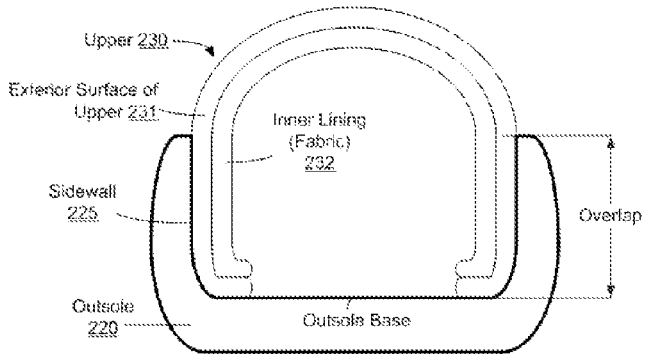
FIG. 2B
200
FIG. 2A
200
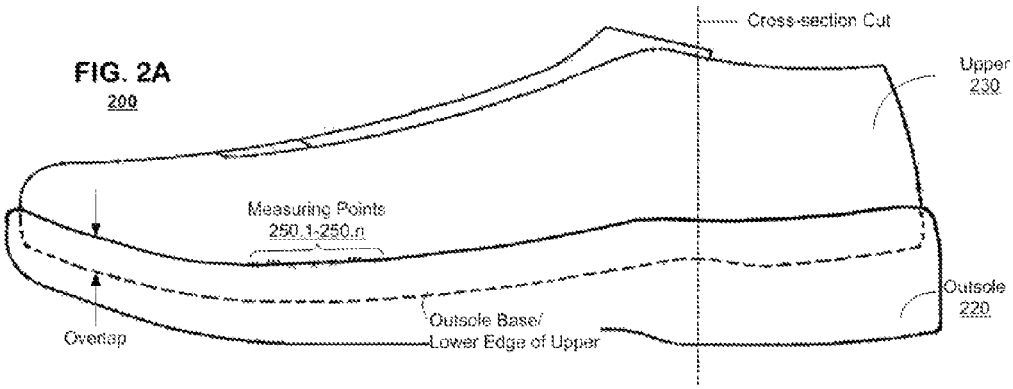

300

400

500

600

700

800

900

1000

FOOTWEAR CONSTRUCTION ELIMINATING THE USE OF A FOXING OR A FOXING-LIKE BAND

BACKGROUND

This invention relates to methods of footwear construction, and in particular to methods of footwear construction that eliminate or reduce the extent of a foxing or a so-called foxing-like band.

Footwear of all types consist of two main parts: the "upper" which, in general, covers the top and sides of the foot and may cover the ankle and lower leg as well, and the "sole" which is below the upper and, in general, includes everything below the "sockline." Footwear may also comprise one or more of the following component parts: an attached heel; linings and/or interlinings; padding (textile wadding, cellular rubber, or plastics material); a removable insole; a removable arch support; a tongue; one or more closure mechanisms such as laces, thongs, hook-and-loop straps, zippers, etc.; ornamentation such as charms, flashing lights, embroidery, appliqués, etc.; pull-on tabs or straps; protective toe-caps (steel or high impact-resistant plastic); spikes, cleats, and similar attachments designed to improve traction; insulation (textile wadding, cellular rubber, or plastics material); and other parts.

For many footwear styles including but not limited to athletic footwear, loafers, pumps, deck shoes, winter boots, work footwear, etc., the upper may consist of many parts. For example, the upper 100 of FIG. 1 illustrates an upper with various pieces such as the toe 110, the vamp 120, eyelet-stays 130, the collar 140, the heel tab 150 (also known as the "moustache"), the heel counter 160, and quarters 170. The upper component parts are commonly made of leather, plastic-coated textile material ("plastic"), compact material or cellular rubber or plastics material, or textile fabrics (woven, knit or nonwoven) in some combination.

Another footwear component is called a "permanent insole." A permanent insole may be a flat piece of footwear structural material intended to support the foot and close an assembled upper to form a "Formed Upper." Permanent insoles are commonly made of cellulosic material or nonwoven textile fabric that has been impregnated with a polymeric material and is often reinforced with textile fabric. An example of a commonly used permanent insole material is the family of products under the trade name TEXON®. When the various pieces of an upper are attached to each other in the proper positions, usually by sewing, adhesives or other means, and when the thus-assembled upper is attached to a permanent insole, the two assemblies form what is called a "Formed Upper."

The sole usually comprises an insole, one or more midsoles, possibly a shank of metal or rigid plastics material, and an outsole which comes into contact with the ground. The pieces making up the sole assembly are commonly made of compact or cellular rubber or plastics material and may or may not be reinforced with textile fabric. Except as noted above, the pieces making up the sole assembly are commonly made of leather or composition leather or compact or cellular rubber or plastics material and may be reinforced or covered with textile fabric. When the various pieces of a sole are attached to each other in the proper positions, usually with adhesives but alternatively by sewing or tacking the parts together, they form what is called a "sole assembly." Almost all footwear is constructed by securely and permanently attaching an upper to a sole assembly.

One method of footwear construction that was commonly used many years ago, especially to make athletic footwear, involved the use of a separate band or strip of material, which was almost always made of rubber, called a "foxing." The foxing was used in the following manner: An upper was placed on top of a sole assembly and the two were securely and permanently attached to each other by covering and sealing the joint between them with a foxing. The bond between the foxing, the upper and the sole assembly was made either by means of an adhesive substance or by the process known as vulcanizing, or much less commonly, by sewing the parts together. For example, the iconic CONVERSE ALL STAR CHUCK TAYLOR™ basketball shoe was constructed by attaching an upper to a sole assembly with a foxing.

Another method of footwear construction that is commonly used today to make athletic and other types of footwear involves the use of what is called a "unit-molded outsole" as illustrated in FIG. 2*a* and FIG. 2*b*, which is a simplified cross sectional view (for example, midsoles and insoles are not shown). A unit-molded outsole 220 is a single piece of rubber or plastics material that is molded in such a way that it has (1) in the central region a concavity or depression (Outsole Base) and (2) vertically rising sidewalls 225 around the perimeter of the central concavity. The central concavity and surrounding sidewalls of the unit-molded outsole 220 are specially shaped and designed to accept an upper 230 in a snug-fitting manner. The lower parts of the upper that are in the vertical plane, are pressed against the sidewalls 225, which are also in the vertical plane, and the lowest parts of the upper that are in the horizontal plane are pressed against the top surface of the central concavity, Outsole base, which is also in the horizontal plane. The parts of the upper 230 and the unit-molded outsole 220 that are in contact with each other are then securely and permanently attached to each other, usually with an adhesive substance or by the process of vulcanization. When a shoe is constructed in this manner, the sidewall feature of the unit-molded outsole 220 serves the same purpose, and performs the same function, as a foxing; that is, the sidewall feature allows the upper 230 and the unit-molded outsole 220 to be securely and permanently attached to each other. For this reason, this sidewall feature is called a "foxing-like band."

Both a foxing and a foxing-like band overlap an upper. A foxing, which is a separate piece of material, is applied at the sole and overlaps the upper and thereby securely and permanently joins together the upper and the sole assembly; while a foxing-like band, which is not a separate piece of material but is part of the unit-molded outsole, is molded at the sole and overlaps the upper and thereby securely and permanently joins together the upper and the sole assembly. The degree to which a foxing or foxing-like band overlaps the upper is called simply the "Overlap."

One method by which the Overlap for a footwear sized for adults or young adults may be measured is as follows: Measuring points 250.1-250.*n* spaced approximately 5 millimeters (mm) apart are marked around the entire perimeter of the footwear. At each point, the amount by which the putative foxing or foxing-like band overlaps the upper at that point is measured, the measurements being taken in the vertical dimension in millimeters (mm) or in fractions of an inch. If the heights of two overlap measurements at any two adjacent points are over one-quarter inch, then the distance "D" (5 mm) between those two points, as measured in the horizontal dimension along the perimeter of the shoe, is recorded as contributing to the total Overlap. Likewise, if the overlap between two adjacent points is less than one-quarter inch, then the distance between those two points does not contribute to the total Overlap. The total Overlap is simply the sum of all the perimeter measurements between adjacent points which have an overlap greater than one-quarter inch divided by the total perimeter of the shoe. The formula for calculating the total Overlap "O" of a footwear, expressed as a percentage, is as follows:

$$O = \left(\frac{\Sigma D}{P}\right) \cdot 100,$$

where O is the Overlap (expressed as a percentage), ΣD is the sum of all distances or lengths of the perimeter where the vertical overlap between two adjacent points is greater than one-quarter inch, and P is the total perimeter length.

The overlap portion provides structural integrity to the shoe while keeping manufacturing costs low; however, it also increases the cost of the shoe in a way not related to the cost of materials or manufacturing. At least eighty percent of footwear sold in the United States is manufactured outside the United States and then imported into the United States for sale. All imported products, including footwear, are classified under a ten-digit code number in the Harmonized Tariff Schedule of the U.S. (HTS; Title 19 U.S.C.), and each ten-digit classification has an associated duty rate. For imported footwear, most of these duty rates are expressed in the form of a percentage of the so-called "transaction value" of the shipment. Upon importation, the shipment is classified under a ten-digit code number, and the importer must then calculate the total amount of import duty on the goods and deposit said amount with U.S. Customs & Border Protection (CBP), an agency of the United States Dept. of Homeland Security.

CBP has hundreds of rules for classifying various products. One such rule for imported footwear is the so-called "Forty-Sixty Rule." This complicated rule states that, for footwear sized for adults and young adults, the footwear does NOT have a foxing or foxing-like band if the cumulative amount by which the sole overlaps the upper by more than one-quarter inch (on the vertical plane), which is the total Overlap "O" as derived above, is not more than 40 percent of the perimeter. Conversely, the footwear DOES have a foxing or foxing-like band if the cumulative overlap is more than 60 percent of the perimeter. Furthermore, the footwear MAY have a foxing or foxing-like band if the cumulative overlap is between 40 percent and 60 percent of the perimeter AND if the putative foxing or foxing-like band resembles the foxing on a traditional sneaker (such as the aforementioned CONVERSE ALL STAR CHUCK TAYLOR™). For footwear sized for adults and young adults, the vertical overlap is one-quarter inch; for footwear sized for boys and girls, the vertical overlap value is three-sixteenths inch, and for footwear sized for infants and toddlers, the vertical overlap value is one-eighth inch.

If the particular style of footwear is found to have a foxing or foxing-like band, the duty rate jumps dramatically in almost all cases. HTS Subheading 6402.99.3165 (6.0 percent duty) covers footwear that does not have a foxing or foxing-like band, while HTS Subheading 6402.99.4060 (37.5 percent duty) covers essentially identical footwear that does have a foxing or foxing-like band. Accordingly, a foxing or foxing like band increases the import duty on footwear of this type by more than six-fold. For this reason, most footwear importers, except those importing very high-end footwear for which price is of little concern, will try to avoid importing footwear that has a foxing or foxing-like band.

Therefore, there is a need in the art for a method of securely and permanently attaching an upper to a sole assembly such that the footwear does not have a foxing or foxing-like band as defined by the so-called "Forty-Sixty Rule."

BRIEF DESCRIPTION OF THE DRAWINGS

FIG. 1 illustrates commonly designated parts of a footwear upper.

FIG. 2A illustrates a footwear construction using a foxing like band.

FIG. 2B illustrates a footwear construction using a foxing like band in a cross-sectional view.

DETAILED DESCRIPTION

Embodiments of the present invention provide a footwear construction that may include an outsole having a sidewall that defines a perimeter of the outsole. The footwear construction may also include an upper attached to the sidewall around the perimeter of the outsole, wherein the sidewall overlaps the upper by more than a critical distance (e.g., one-quarter inch) for not more than 40% of the perimeter of the outsole. Said another way, the sidewall overlaps the upper by less than the critical distance for at least 60% of the perimeter of the outsole.

Embodiments of the present invention provide a method to construct footwear that may include attaching an upper to an outsole, wherein the sidewall overlaps the upper by more than a critical distance (e.g., one-quarter inch) for not more than 40% of the perimeter of the outsole.

Embodiments of the present invention provide a footwear construction that may include an upper coupled to a midsole. The footwear construction may also include a perimeter defining outsole coupled to the upper and midsole, wherein the upper encloses the midsole around the perimeter.

Embodiments of the present invention provide a method to construct footwear that may include attaching an upper to a midsole enclosing the midsole and forming an upper-midsole assembly. The method may also include attaching the upper-midsole assembly to an outsole.

Embodiments of the present invention provide a footwear construction that may include an outsole having a sidewall that defines a perimeter of the outsole and a trough running the perimeter of the outsole. The footwear construction may also include an upper coupled to the trough, and a ring coupled to the upper in the trough.

Embodiments of the present invention provide a method to construct footwear that may include attaching an upper to an outsole, wherein lower areas of the upper are attached to a trough running around a perimeter of the outsole. The method may also include attaching a ring on top of the upper in the trough.

Figure 3A:
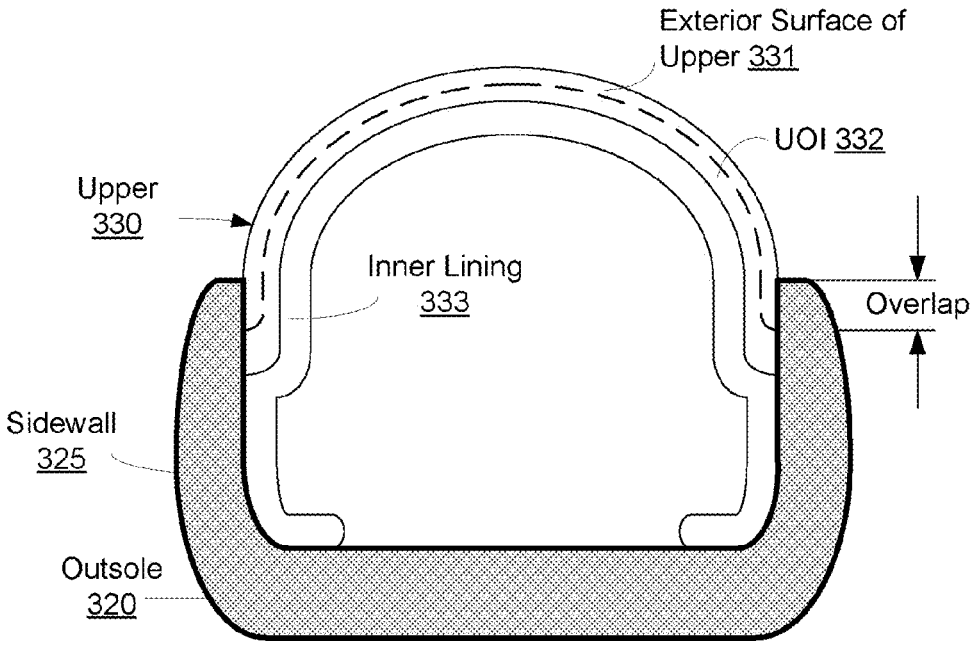
FIG. 3 illustrates a footwear construction in a cross-sectional view according to an embodiment of the present invention.

FIG. 3A illustrates a footwear construction 300 in a simplified cross-sectional view according to an embodiment of the present invention. Footwear construction 300 may include outsole 320 and an upper 330. The outsole 320 maybe be a unit-molded outsole and may include a sidewall 325 that defines the perimeter length of the outsole 320. Upper 330 may include an outer portion 331 and upper-outsole interfacing (UOI) portion 332. The outer portion 331 may be securely and permanently attached on all portions of its interior surfaces to the UOI 332. The UOI 332 may include one or more layers of woven, knit or nonwoven textile fabrics, cellulosic material (e.g. TEXON®), bonded or composition leather, reinforced or laminated rubber or plastics material, or other similar type material. The UOI 332 may be durable and resistant to tearing, stretching, and other deformations, but the UOI 332 may also be unaesthetic and/or permeable to the elements. Consequently, the UOI 332 must not be plausible upper material and must not be visible on the exterior surface of the upper.

The upper 330 may be attached to the outsole 320 in the overlap region by means of gluing, sewing or other techniques. The outer portion 331 of the upper 330 may abut the top of the sidewalls or may only very slightly be overlapped by the sidewalls.

The inner lining 333 may be coupled to the upper 330. The inner lining may be a nonwoven textile fabric that is unsuited to exposure to the elements. The inner lining 333 may spatially overly the entire length of the upper 330 as shown in FIG. 3A. The inner lining 333 may be glued or sewn to the upper 330. The inner lining 240 may also be coupled the outsole 320. The inner lining 333 may run vertically down the outsole's inner sidewall 325 in the non-overlap region until it turns horizontal on the outsole's base providing padding for the shoe. The inner lining 333 may be glued or sewn to the outsole 320.

The UOI 332 may be securely and permanently attached to a portion of the inner sidewall 325, the portion labeled as overlap in FIG. 3A, thus attaching the upper 330 to the outsole 320. The overlap region may be uniform around the entire perimeter of the outsole 320 or may vary in height. The cumulative total length where the sidewall overlaps the upper by more than the critical distance must not be more than 40% of the perimeter of the outsole. The critical distance may depend on the size of the shoe:

one-quarter of an inch for an adult's shoe.

three-sixteenths of an inch for a child's shoe.

one-eighth of an inch for an infant's shoe.

Again, stated another way, the sidewall overlaps the upper by less than the critical distance for at least 60% of the perimeter of the outsole.

Since the sidewall 325 may only overlap a portion of the upper 330 and not entirely, the overlap portion of footwear construction 300 does not qualify as a foxing-like band.

Figure 4A:
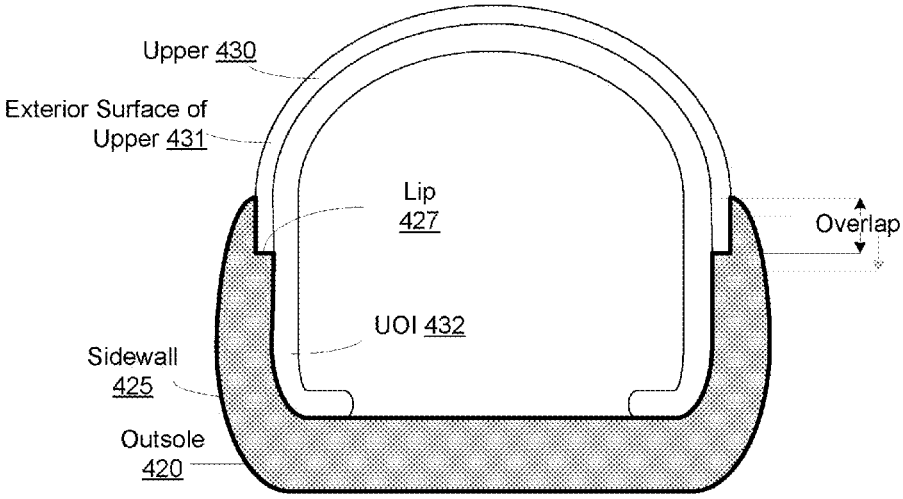
FIG. 4A illustrates a footwear construction in a cross-sectional view according to an embodiment of the present invention.

FIG. 4 illustrates a footwear construction 400 in a simplified cross-sectional view according to an embodiment of the present invention. Footwear construction 400 may include an outsole 420 and an upper 430. The upper 430 may include an outer portion 431 and upper-outsole interfacing (UOI) portion 432 similar to the upper 330 of FIG. 3. The outer portion 431 may be securely and permanently bounded on all portions of its interior surfaces to the UOI 432. The UOI 432 may include one or more layers of woven, knit or nonwoven textile fabrics, cellulosic material (e.g. TEXON®), bonded or composition leather, reinforced or laminated rubber or plastics material, or other similar type material. The UOI may be durable and resistant to tearing, stretching, and other deformations, but the UOI may also be unaesthetic and/or permeable to the elements. Consequently, the UOI 432 must not be plausible upper material that is designed to be seen on the visible exterior surface of the footwear.

The outsole 420 may have an inner sidewall 425 that may include an indented lip 427. The lip 427 may be on the inside surface of the sidewall at or near the top of the sidewall, and may extend around the entire perimeter of the sidewall or only a portion thereof. The lip 427 may be flat (i.e. horizontal), "U" shaped, "V" shaped, "W" shaped, wedge-shaped, or other suitable shaped. The width of lip 427 may be sufficient to provide a secure resting place for the lower edge of the externally visible outer portion. The height of lip 427, labeled as overlap, overlaps the upper by more than the critical distance for not more than 40% of the perimeter of the outsole. The upper 420 may be coupled to the lip 427 by a lip molding.

Footwear construction's 400 lip molding technique provides a securing mechanism for the upper 430 to the outsole 420 without the use of a foxing-like band. During manufacture, factory workers may use the lip 427 as a resource to ensure proper registration between the upper 430 and the sidewall 425. Therefore, footwear construction 400 minimizes production costs relative to conventional shoe assemblies.

Figure 4B:
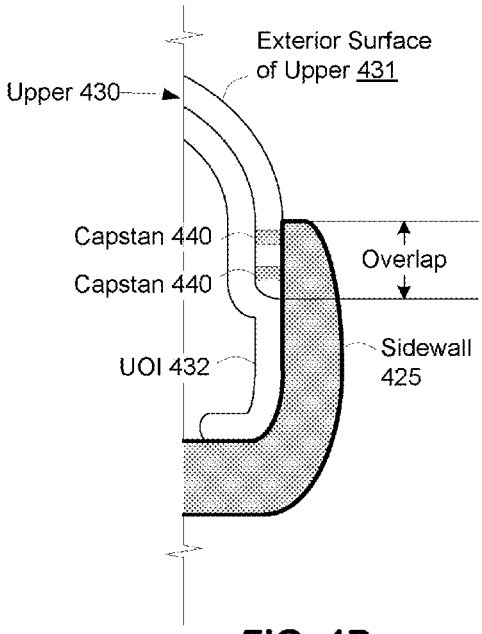
FIG. 4B illustrates a footwear construction in a detailed cross-sectional view according to an embodiment of the present invention.
Figure 4C:
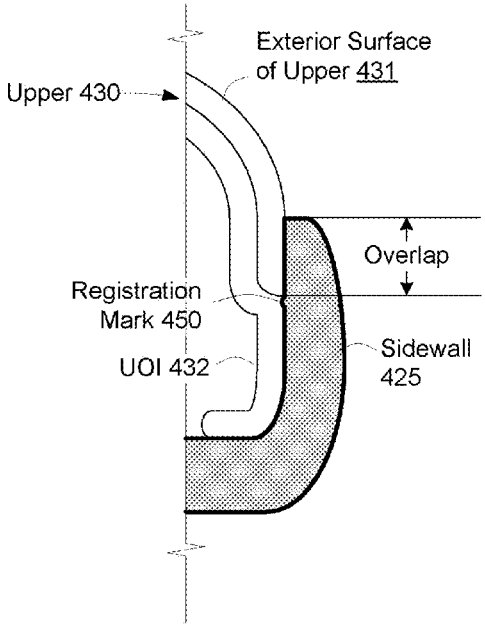
FIG. 4C illustrates a footwear construction in a detailed cross-section view according to an embodiment of the present invention.

According to an embodiment, the outsole 420 may include formations provided on an interior face of the sidewall 425 to ensure proper registration between the upper 430 and the sidewall 425 during manufacture. FIGS. 4B and 4C illustrate two examples of such formations. In FIG. 4B, the sidewall 425 may include a plurality of capstans 440 that project outward from the interior face of the sidewall 425. Although only two capstans 440 are illustrated in the sectional view of FIG. 4B, the sidewall 425 may include a larger number of capstans provided around the length of the sidewall 425. The capstans are provided to engage holes provided on a portion of the upper 430 that will be overlapped by the sidewall 425. Once the capstans 440 are engaged with corresponding holes in the uppers 430 (optionally with an adhesive), the capstan engagement 440 will provide a mechanical force to keep the upper 430 engaged with the sidewall 425. The number of capstans 440 likely will vary based upon the size of the shoe and the materials chosen for the upper 430.

In an embodiment, the uppers 430 and outsoles 420 may be manufactured according to patterns that permit the holes and capstans 440 to engage only if there is proper registration between the upper 430 and sidewall. For example, the patterns may prevent engagement between the holes and capstans 440 in the event of a manufacturing error that would cause mis-registration between the sidewall 425 and the upper 430 that would result in an overlap that exceeds the critical distance over more than 40% of the perimeter of the outsole.

Another embodiment is illustrated in FIG. 4C. In this embodiment, the outsole 420 may include a registration mark 450 provided on an interior face of the sidewall 425. The registration mark may extend over the length of the sidewall 425 and may identify a location to align a terminal end of the upper 430 during manufacture. The registration mark 450 may be provided as a projection or indention on the interior face of the sidewall 425. In an embodiment, when the projection mark 450 is provided as a projection, it may be sized so as to interfere with the upper 430 if the upper were improperly registered with the sidewall (e.g., mounted too deep with respect to the sidewall so as to violate the critical distance principles described above).

As discussed, the principles of the present invention provide a shoe configuration in which a sidewall overlaps the shoe's upper by more than a critical distance (e.g., one-quarter inch) for not more than 40% of the perimeter of the outsole. Some portions of the upper are permitted to exceed the critical distance so long as the total length of these portions do not exceed 40% of the perimeter in aggregate. Consequently, the present invention leads to a variety of configurations of the upper, some of which are shown in FIGS. 5-8.

Figure 5:
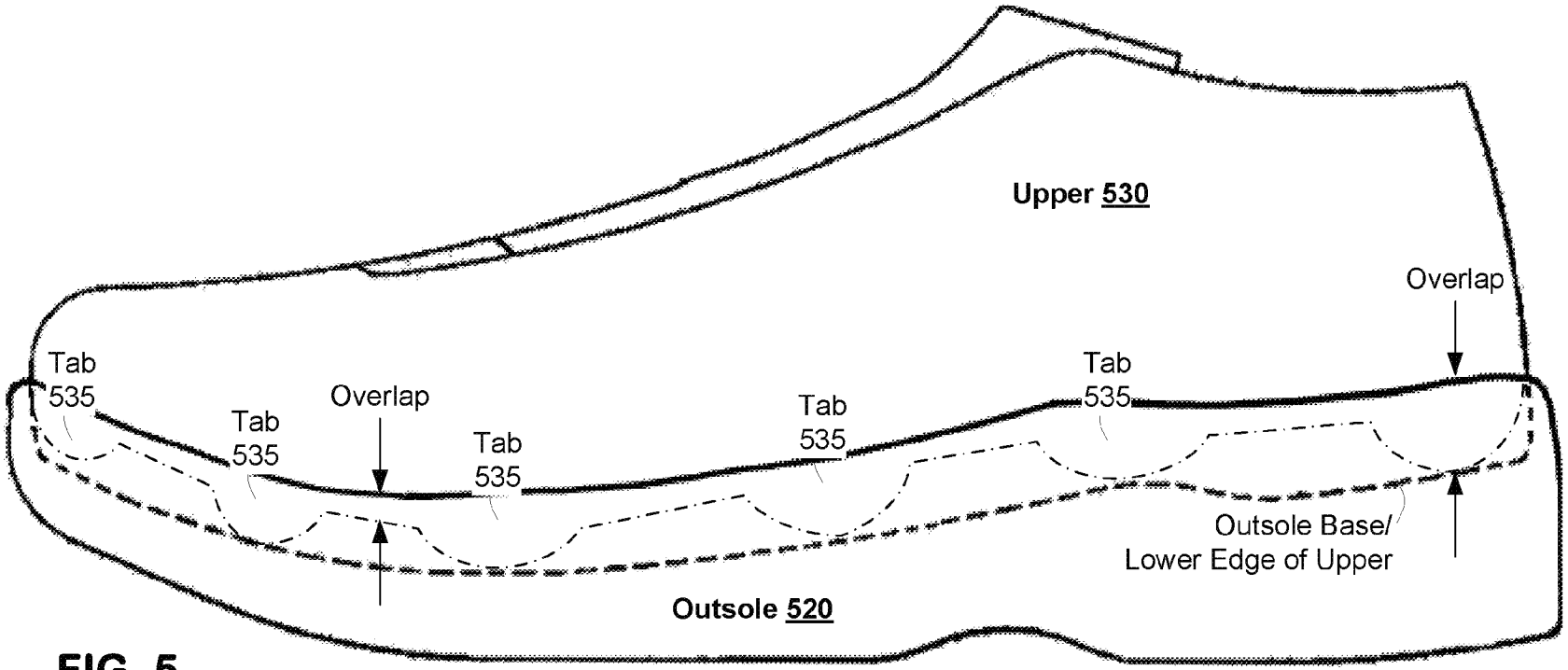
FIG. 5 illustrates a footwear construction according to an embodiment of the present invention.

FIG. 5 illustrates a footwear construction 500 according to an embodiment of the present invention. Footwear construction 500 may include an outsole 520, an upper 530. The construction also may include an inner lining, midsoles and/or insoles which are not shown. The upper 530 may be coupled to the inner wall of the outsole 520 by one or more tabs 535. The tabs 535 may be spaced apart by a distance labeled "gap." The size of the gaps between the tabs may be the same between every tab or may vary between tabs. The tabs 535 may be semi-circular shaped and may be uniformly distributed along the outsole's 520 perimeter. The tabs may form a wavy line such as a sine wave or a wave with an amplitude that decreases asymptotically from the heel forward.

The inner wall of the outsole may overlap the tabs 535 entirely or partially. The tabs 535 may extend greater than 5 mm down the inner wall. The aggregate length of the tabs 535 may be 60% or less of the perimeter of the outsole 520. The outsole's inner wall may also overlap the upper in the gaps. The overlap in the gaps may be less than the critical distance. The aggregate length of the gaps may be 40% or more of the perimeter of the outsole 520. Therefore, footwear construction 400 while minimizing materials in the upper 530 does not use a foxing-like band.

Figure 6:
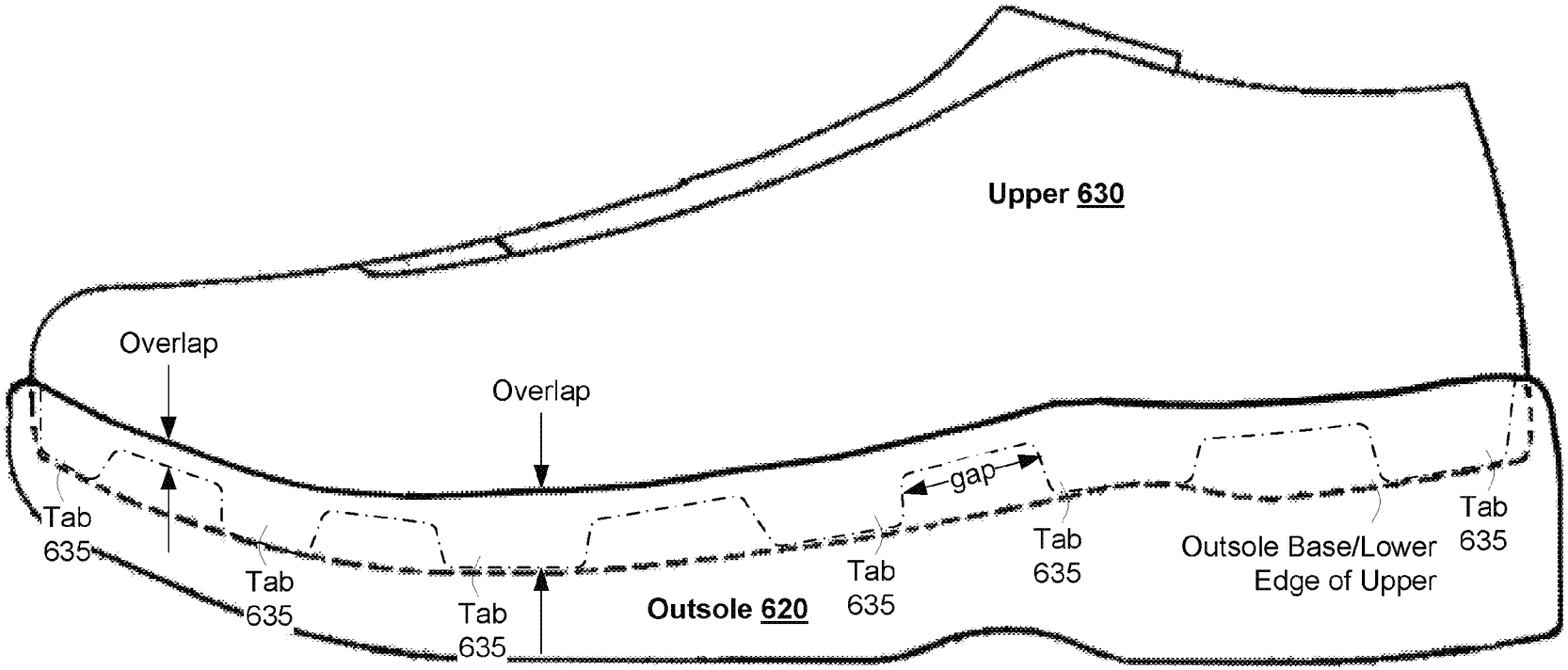
FIG. 6 illustrates a footwear construction according to an embodiment of the present invention.
Figure 7:
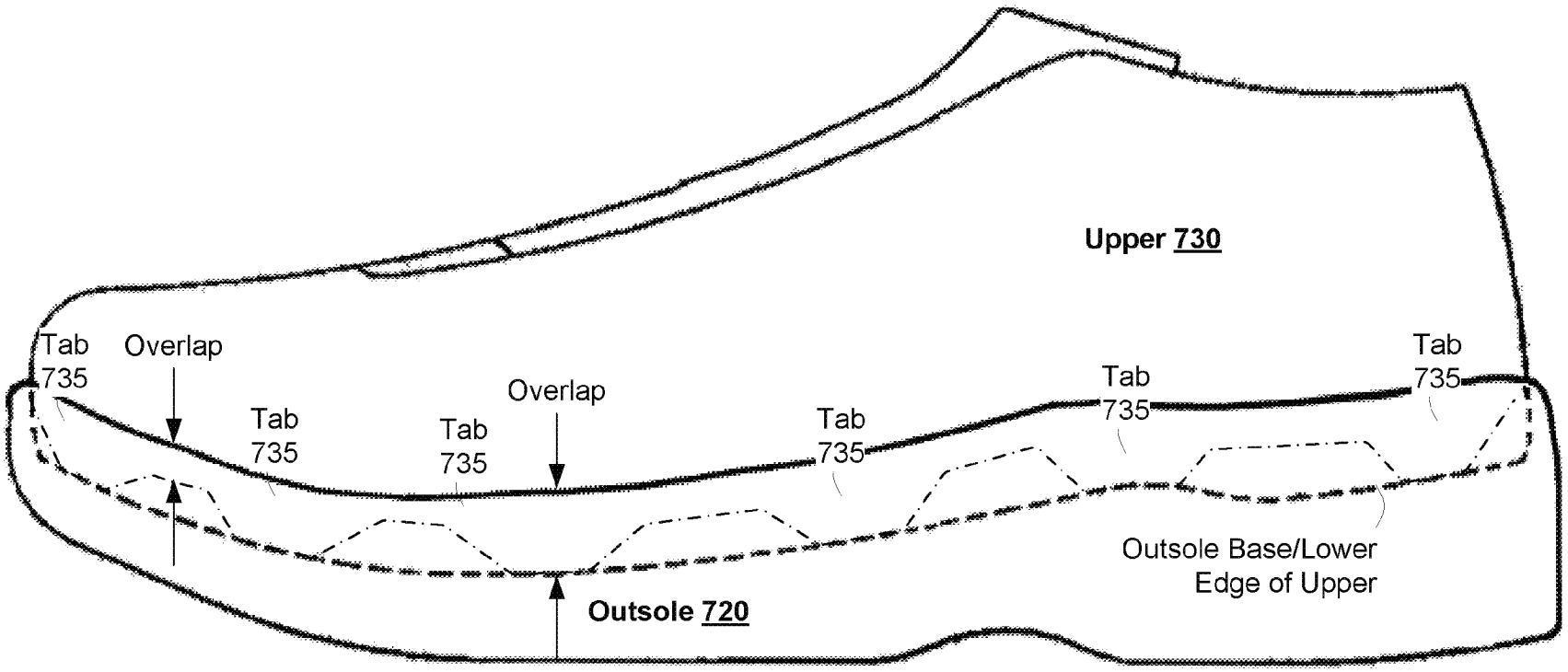
FIG. 7 illustrates a footwear construction according to an embodiment of the present invention.

Tabs attaching the upper to the inner wall of the outsole may be a variety of shapes. FIG. 6 illustrates a footwear construction 600 according to an embodiment of the present invention with trapezoidal shaped tabs 635 forming a square wave pattern. FIG. 7 illustrates a footwear construction 700 according to an embodiment of the present invention with triangular shaped tabs 735 forming a saw tooth pattern. The shape of the tabs are not limited by the illustrated shaped tabs, but may be any shape or combination of shapes forming any pattern or combination of patterns according to the present invention. Moreover, the sizes of the tabs and depths to which they extend may vary throughout.

Figure 8:
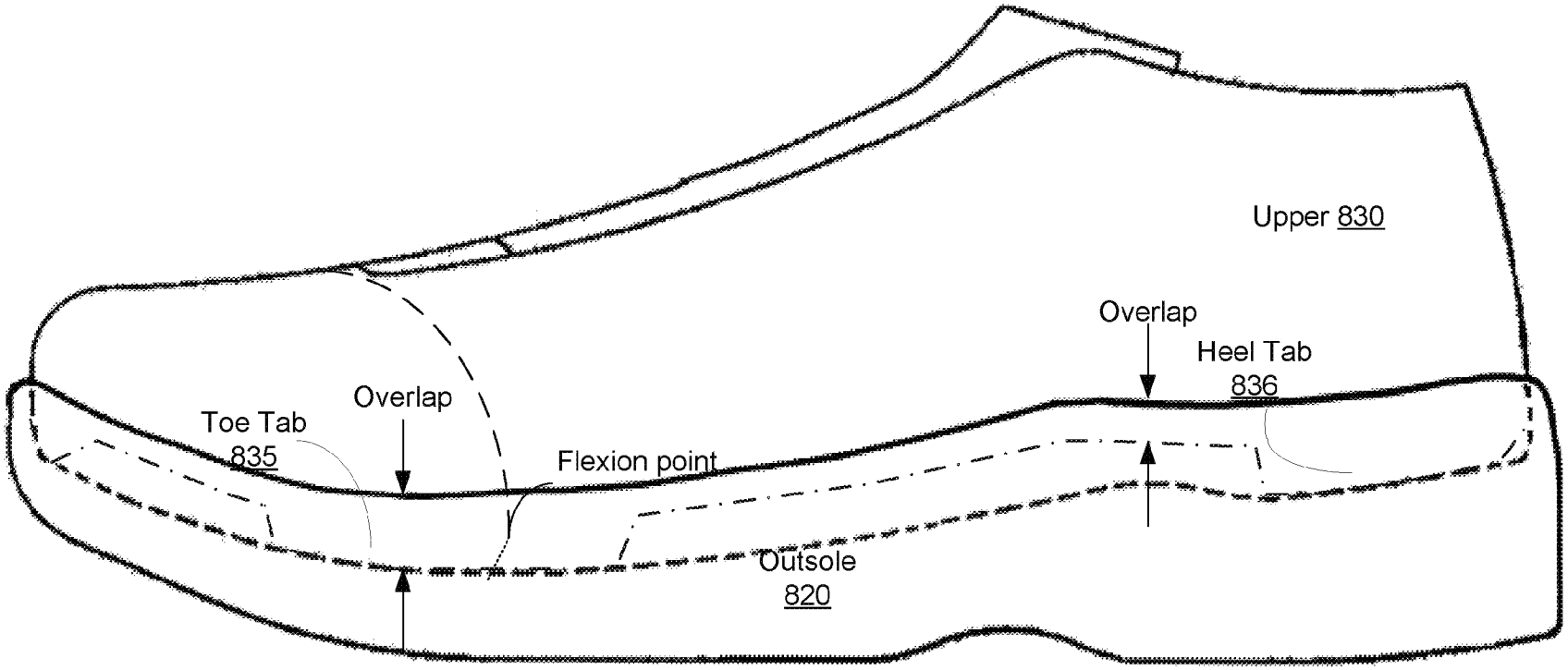
FIG. 8 illustrates a footwear construction according to an embodiment of the present invention.

FIG. 8 illustrates a footwear construction 800 according to an embodiment of the present invention. Footwear construction 800 may include an outsole 820, an upper 830, and inner lining (not shown). The upper 830 is coupled to the inner wall of the outsole 820 by two tabs, toe tab 835 and heel tab 836. The toe tab 835 may cover a toe area of the footwear construction 800, and heel tab 836 may cover a heel area of the footwear construction 800. Also, the two tabs 835, 836 may cover the locations of shoe flexion around the perimeter of the outsole 820. According to this embodiment, the medial and lateral side of the footwear construction 800 may not have an overlap between the outsole 820 and upper 830 therein. Alternatively, the medial and lateral side of the footwear construction 800 may have an overlap between the outsole 820 and upper 830 that is less than the critical distance for less than 40% of the footwear construction's perimeter.

The inner wall of the outsole may overlap the tabs 835, 836 entirely or partially. Footwear construction 800 while minimizing materials in the upper 830 also eliminates or reduces the foxing-like band.

Figure 9:
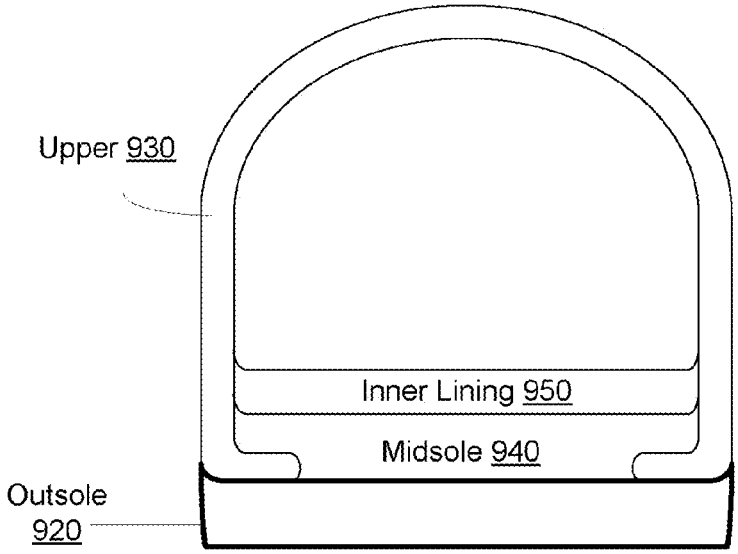
FIG. 9 illustrates a footwear construction according to an embodiment of the present invention.

FIG. 9 illustrates a footwear construction 900 in a simplified cross-sectional view according to an embodiment of the present invention. Footwear construction 900 may include an outsole 920 that comprises one or more layers of compact rubber or plastics material that has a tough lower surface suitable for coming into contact with the ground. The outsole 920 may have sidewalls of any height for less than 40% of the perimeter and no sidewalls (i.e. flat surface) for at least 60% of the perimeter as shown in FIG. 9. The sidewalls may be apportioned around the perimeter of the outsole around the toes, around the heel, along the lateral side at the arch, and along the medial side at the big toe.

Footwear construction 900 may include one or more midsole 940. The midsole 940 may be compact or cellular rubber or plastics material. The lowest midsole 940 (i.e. the closest to the ground) may have a thickness of approximately one-half inch and not less than one-eight inch.

Footwear construction 900 may include an upper 930. The upper 930 may turn inward at a right angle at the lower part of the upper 930 so that the upper 930 encloses the lowest, thickest midsole 940. The upper 930 may also enclose one or more other midsoles. The upper 930 may be gathered at the concave (spherical) curves around the toe and heel, and may be slit at the convex (hyperbolic) arcs along the lateral and medial arches. The upper 930 may be securely and permanently attached to the midsole 940, which it encloses by means of adhesive or by sewing, vulcanization, or other suitable means. The upper and midsole assembly may be securely and permanently attached to the falt upper surface of the outsole 920 by means of adhesive or by sewing, vulcanization, or other suitable means.

The upper 930 may be attached to the sole assembly without the use of a foxing or foxing-like band because the outsole 920 overlaps the formed upper 930 by more than the critical value for a cumulative total length of not more than 40% of the perimeter.

Figure 10:
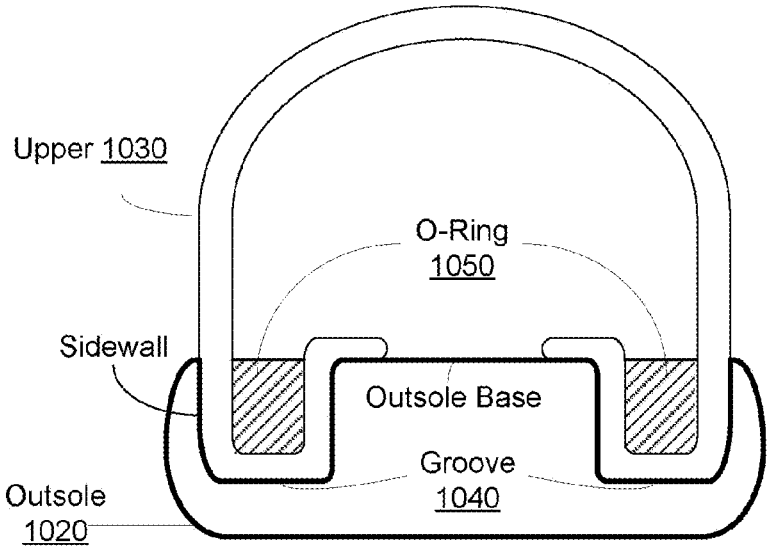
FIG. 10 illustrates a footwear construction in a cross-sectional view according to an embodiment of the present invention.

FIG. 10 illustrates a footwear construction 1000 in a simplified cross-sectional view according to an embodiment of the present invention. Footwear construction 1000 may include an outsole 1020, an upper 1030, and an o-ring 1040. The outsole may be a unit-molded outsole that is molded to have a trough 1040 running around the entire perimeter just inward of the outsole's sidewall. The sidewalls may form one wall of the trough 1040 and an elevated central portion may form the other wall of the trough 1040. The trough 1040 may be a flat shaped, "V" shaped, "W" shaped, or "U" shaped.

The o-ring 1040 may be a long, flexible piece of material, which may be of compact rubber or plastics material, leather (e.g., a thong), textile rope or cord, or other suitable material. The cross-sectional shape of the o-ring may be complimentary to the trough's shape so that the o-ring 1050 fits snugly into the trough 1040 when pushed down into it.

The top of the sidewall may be higher than the top surface of the outsole 1020 inward of the trough 1040 by more than the critical value for a cumulative length of less than 40% of the perimeter of the outsole 1020. The upper 1020 may be placed on top of the outsole 1020 so that its lower areas may be pressed down into the trough 1040, conforming to the shape of the trough 1040. The o-ring 1050 may then be forced down into the trough 1040 on top of the upper 1030 so that the upper 1030 is held snugly in place. The entire footwear construction 1000 may be securely and permanently attached to each other by means of adhesive or by sewing, vulcanization, or other suitable means. Moreover, footwear construction 1000 does not use a foxing or foxing-like band to secure the upper to the outsole.

Several embodiments of the present invention are specifically illustrated and described herein. However, it will be appreciated that modifications and variations of the present invention are covered by the above teachings and within the purview of the appended claims without departing from the spirit and intended scope of the invention.

I claim:

1. A footwear construction comprising:

an outsole having a sidewall that defines a total length of an inside perimeter of the outsole; and an upper coupled to the sidewall around the inside perimeter of the outsole;

wherein the sidewall includes an indented lip for engagement with the upper, and wherein the sidewall of the outsole overlaps an exterior side of the upper over a surface area which has two dimensions, a length and a width;

wherein the length of the overlapping surface area extends horizontally along the inside perimeter of the outsole;

wherein the width of the overlapping surface area is substantially perpendicular to the length of the overlapping surface area;

wherein the two dimensions are set to comply with a requirement:

a value of the width of the overlapping surface area exceeds a preset threshold over the length of the overlapping surface area for no more than 40% of the total length of the inside perimeter of the outsole; and wherein the indented lip of the sidewall is positioned to secure the upper to ensure that the overlapping surface area is in compliance with the requirement.

2. A footwear construction comprising:

an outsole having a sidewall that defines a total length of an inside perimeter of the outsole; and an upper coupled to the sidewall around the inside perimeter of the outsole;

wherein the sidewall includes a pattern of projections provided on an interior surface thereof that engage a corresponding pattern of holes in the upper, and wherein the sidewall of the outsole overlaps an exterior side of the upper over a surface area which has two dimensions, a length and a width;

wherein the length of the overlapping surface area extends horizontally along the inside perimeter of the outsole;

wherein the width of the overlapping surface area is substantially perpendicular to the length of the overlapping surface area;

wherein the two dimensions are set to comply with a requirement:

a value of the width of the overlapping surface area exceeds a preset threshold over the length of the overlapping surface area for no more than 40% of the total length of the inside perimeter of the outsole; and wherein the pattern of projections engage the corresponding pattern of holes to ensure that the overlapping surface area is in compliance with the requirement.

3. A footwear construction comprising:

an outsole having a sidewall that defines a total length of an inside perimeter of the outsole; and an upper coupled to the sidewall around the inside perimeter of the outsole;

wherein the sidewall includes a registration mark provided on an interior surface thereof that marks a location of an edge of the upper, and wherein the sidewall of the outsole overlaps an exterior side of the upper over a surface area which has two dimensions, a length and a width;

wherein the length of the overlapping surface area extends horizontally along the inside perimeter of the outsole;

wherein the width of the overlapping surface area is substantially perpendicular to the length of the overlapping surface area;

wherein the two dimensions are set to comply with a requirement:

a value of the width of the overlapping surface area exceeds a preset threshold over the length of the overlapping surface area for no more than 40% of the total length of the inside perimeter of the outsole; and wherein the registration mark of the sidewall marks the location of the edge of the upper to indicate that the overlapping surface area is in compliance with the requirement.

* * * * *